US012385713B2

(12) United States Patent
Liu

(10) Patent No.: US 12,385,713 B2
(45) Date of Patent: Aug. 12, 2025

(54) ARROW CHAIN STRUCTURE

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 164 days.

(21) Appl. No.: 18/204,953

(22) Filed: Jun. 2, 2023

(65) Prior Publication Data

US 2024/0401898 A1 Dec. 5, 2024

(51) Int. Cl.

| | |
|---|---|
| ***F41B 5/06*** | (2006.01) |
| ***F41B 5/14*** | (2006.01) |
| ***F41B 11/50*** | (2013.01) |
| *F41B 5/12* | (2006.01) |

(52) U.S. Cl.

CPC ..... *F41B 5/1403* (2013.01); *F41B 11/50* (2013.01); *F41B 5/126* (2013.01)

(58) Field of Classification Search

CPC .. F41B 5/06; F41B 5/066; F41B 5/126; F41B 11/50

See application file for complete search history.

(56) References Cited

U.S. PATENT DOCUMENTS

| | | | | |
|---|---|---|---|---|
| 4,541,403 | A * | 9/1985 | DeBlois | F41B 5/1438 124/25.7 |
| 6,666,204 | B1 * | 12/2003 | Hedrick | F41B 5/066 224/916 |
| 12,061,060 | B1 * | 8/2024 | Liu | F41A 9/32 |
| 2010/0154765 | A1 * | 6/2010 | Klockener | F41B 11/723 124/51.1 |
| 2022/0107151 | A1 * | 4/2022 | Bennink | F41A 3/66 |

* cited by examiner

*Primary Examiner* — John A Ricci

(57) ABSTRACT

An arrow chain structure includes an arrow chain body and an extension member. The arrow chain body has a base part, the base part has an arrow groove and a pivoting member disposed on a side thereof, the pivoting member has an accommodation groove formed on a side thereof corresponding to the other side of the arrow groove. The extension member is disposed on the arrow chain body. The arrow chain bodies can be pivotally connected to each other by the pivoting members.

12 Claims, 11 Drawing Sheets

ARROW CHAIN STRUCTURE

BACKGROUND OF THE INVENTION

1. Field of the Invention

The present invention is applied to a shooting technical field, and more particularly to an arrow chain structure capable of mounting multiple arrow bodies.

2. Description of the Related Art

With the prosperity of sports in recent years, more people who love sports are gradually trying many new sports, such as Korfball, dragon boat, archery and so on. Among these sports, archery has fun, trains concentration and muscle endurance of arm, so more and more people are involved in archery, even archery starts becoming one of the sport competitions. In archery, a user usually carries quivers on waist and leg and puts several arrows in the quivers, and the user must draw an arrow from the quiver and perform mounting, setting aiming actions again after each shot. For a professional archery user, these archery processes must be completed in one go, to avoid the loss of sight and misjudgment due to external interference during the archery process. Therefore, during the above-mentioned shooting process, the archer must pay concentration on repeatedly drawing arrow and refocusing on a shooting operation, and it is too mentally exhausting for the archer and results in poor concentration and affecting the performance of the game. During the competition, the time between two shots is regulated and cannot be too long; however, after each shot is completed, the archer mush re-mount a new arrow, so the overall shooting time is undoubtedly extended and it is also one of the factors that affect shooting accuracy and stability.

Taiwan patent application No. 109123886 discloses an automatic arrow-loading device for a crossbow, to improve a conventional technology problem that arrows must be drawn and replenished one by one to shoot, the automatic arrow-loading device is mounted on a crossbow to accommodate multiple arrow bodies and includes an arrow box mounted on a top surface of the crossbow, the arrow box has an arrow groove cut from a top thereof to a bottom thereof, and multiple arrow bodies are placed and stacked in the arrow groove with each other in a direction where head ends of the arrow bodies face a shooting direction. The automatic arrow-loading device includes a press arm, an end of the pressing arm is pivotally assembled in the arrow groove of the arrow box, and the other end of the pressing arm is normally pressed against the arrow body in the arrow groove. During the operation of the crossbow, the arrow body at the bottom of the multiple arrow bodies falls on the crossbow; after firing, the user repeats the operation to make the arrow body at the bottom of the multiple arrow bodies fall on the crossbow again in cooperation with the pressing arm, so that the user can continue to shoot, thereby achieving the purpose and effect of reducing arrow drawing and mounting arrows.

However, the above-mentioned conventional technology still has a deficiency. In order to achieve the effect of making the arrow bodies repeatedly fall into the crossbow for continuous shooting, it is necessary to pivotally swing the pressing arm to make the barb-shaped end of the press arm leave the arrow groove, and an appropriate number of the multiple arrow bodies are loaded under the limitation in a height of the arrow groove. When the multiple arrow bodies are loaded and the press arm is pivoted back to its original position, after the user finishes the pre-firing operation process of the crossbow, the bowstring is pulled towards the stopper for engaging the string in the sliding track, and the end of the bowstring pushed against the stopper is swung toward a chamber until the bowstring passes the stopper; next, the stopper is returned to the original position by an elastic force of a torsion spring, to limit the launch of the bowstring. At the same time, since the restriction with the bowstring is released, the arrow body set at the bottom of the arrow bodies falls on the arrow groove of a gun frame and wait for firing. According to the explanation the means and structure of the automatic arrow-loading device disclosed in Taiwan patent application No. 109123886, it is found that the automatic arrow-loading device solves the problem of prolonging the shooting operation time and affecting shooting accuracy and stability due to repeated drawing and mounting of arrows; however, the operation and structure of the automatic arrow-loading device is extremely complex, and the complex structure leads to an increase in material costs and a prolongation of manufacturing hours.

Taiwan patent application No. 110113232 discloses an arrow box device capable of locating multiple arrow bodies to solve the problem that arrows must be drawn and replenished one by one to shoot in the conventional technology; the arrow box device for accommodating multiple arrow bodies includes a front end, a rear end opposite to the front end part, a top, a bottom opposite to the top, and an arrow-holding channel cut from the top to the bottom. The arrow-holding channel has an upper cutout located at the top of the arrow box device, and a lower cutout located on the bottom of the arrow box device. The upper cutout and the lower cutout are connected in the arrow-holding channel. When mounting an arrow body, an operator mainly places the arrow body horizontally from the upper cutout, and the arrow body then slowly falls into the bottom of the arrow-holding channel and falls into the arrow groove by the weight of the arrow body to wait for firing. After firing, another arrow body falls into the arrow groove from the bottom of the arrow-holding channel by its own weight, so as to achieve the effect of continuous shooting. According to explanation of the means and structure of the arrow box device disclosed in Taiwan patent application No. 110113232, it is found that the arrow box device solves the user's need to reload the arrow after each shot but still has the deficiency, the same as the automatic upper arrow device disclosed in TW patent application No. 109123886, that the structure of the arrow box device is complex.

SUMMARY OF THE INVENTION

An objective of the present invention is to provide a chain-type arrow chain structure formed by pivotally connecting arrow chain bodies with each other through pivoting members, so that the chain-type arrow chain structure is able to mount arrow bodies and has a bendable and woundable structure to achieve the effect of easy to accept and carry.

In order to achieve the above-mentioned objective, the present invention provides an arrow chain structure including arrow chain bodies and extension members. Each of the arrow chain bodies includes a base part, the base part has an arrow groove and a pivoting member disposed on a circumferential side thereof. The pivoting member has an accommodation groove formed on a side thereof corresponding to the other side of the arrow groove. Each of the extension members includes an accommodation end and a pivoting end, the accommodation end is accommodated in the accommodation groove, and the pivoting end is pivotally connected to the pivoting member. After each of the extension members is assembled with one of the arrow chain bodies, the arrow chain bodies are pivotally connected to each other to form a chain-type arrow chain structure via the pivoting members.

In order to achieve the above-mentioned objective, the present invention provides an arrow chain structure including arrow chain bodies; each of the arrow chain bodies includes a base part, the base part includes an arrow groove and a pivoting member disposed on a side thereof. The arrow chain bodies are pivotally connected to each other to form a chain-type arrow chain structure via the pivoting members.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
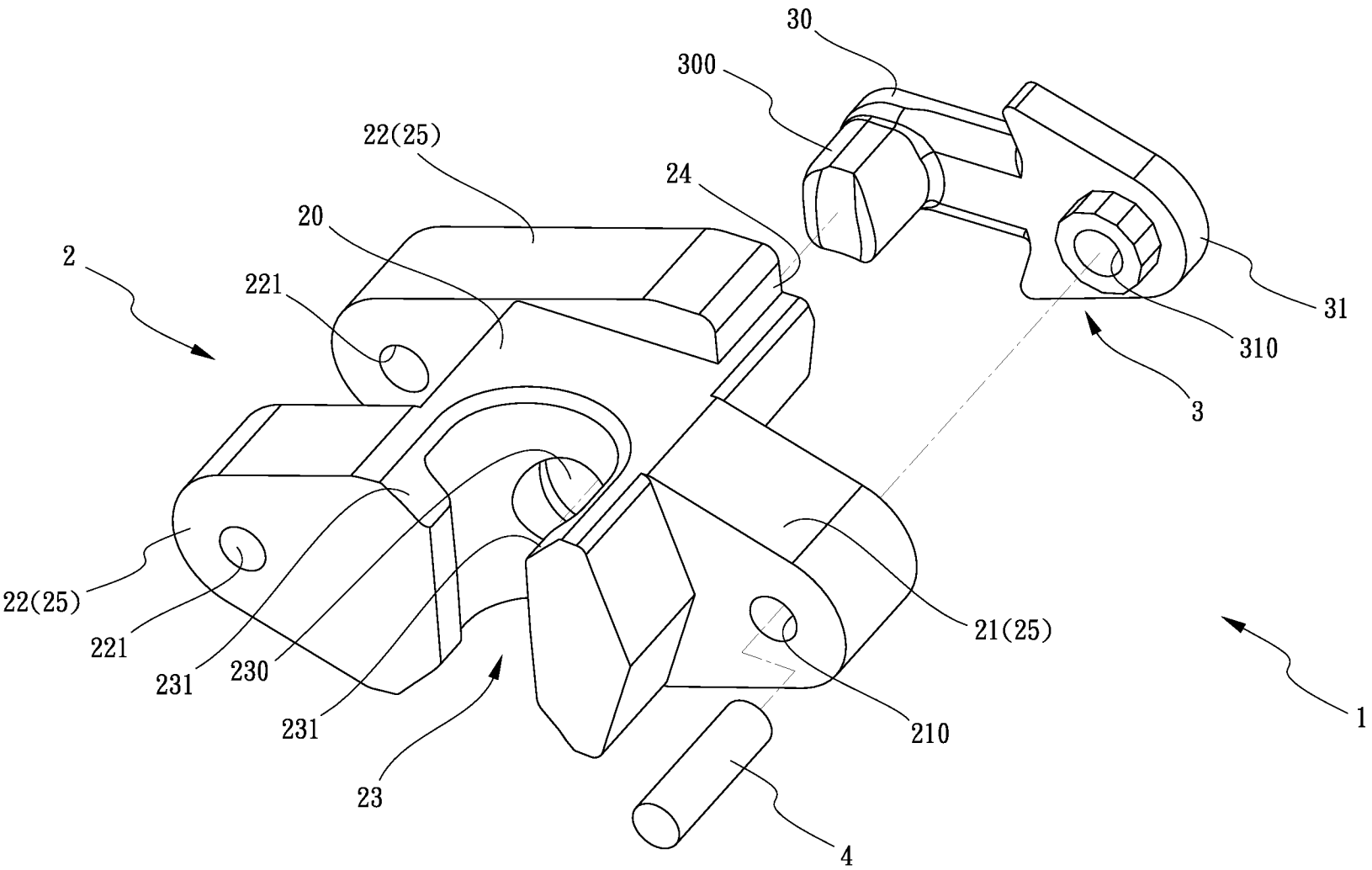
FIG. 1 is a perspective exploded view of an arrow chain structure of a first embodiment, according to the present invention.
Figure 2:
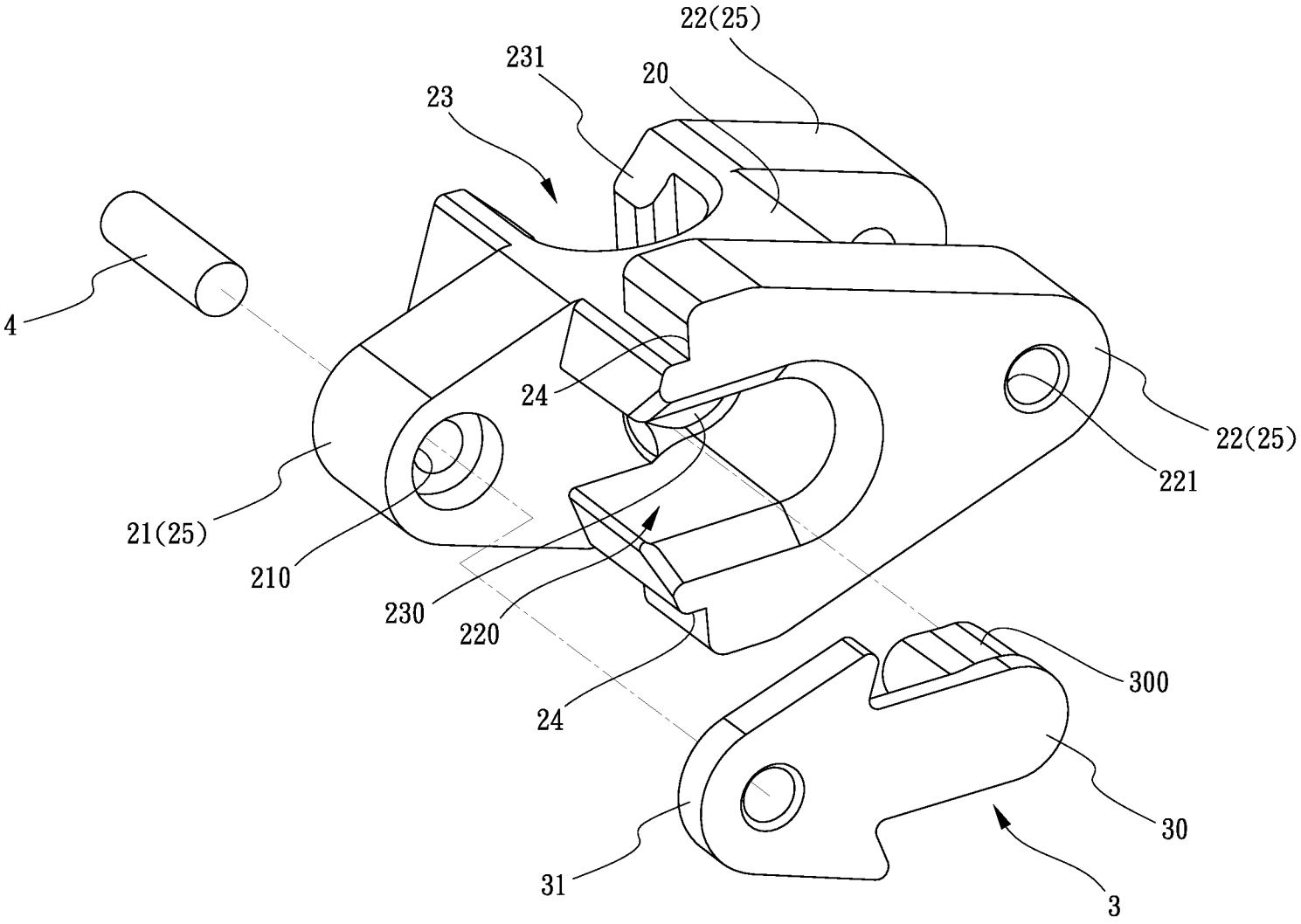
FIG. 2 is a perspective exploded view of the arrow chain structure of the first embodiment, when viewed from another angle.
Figure 3:
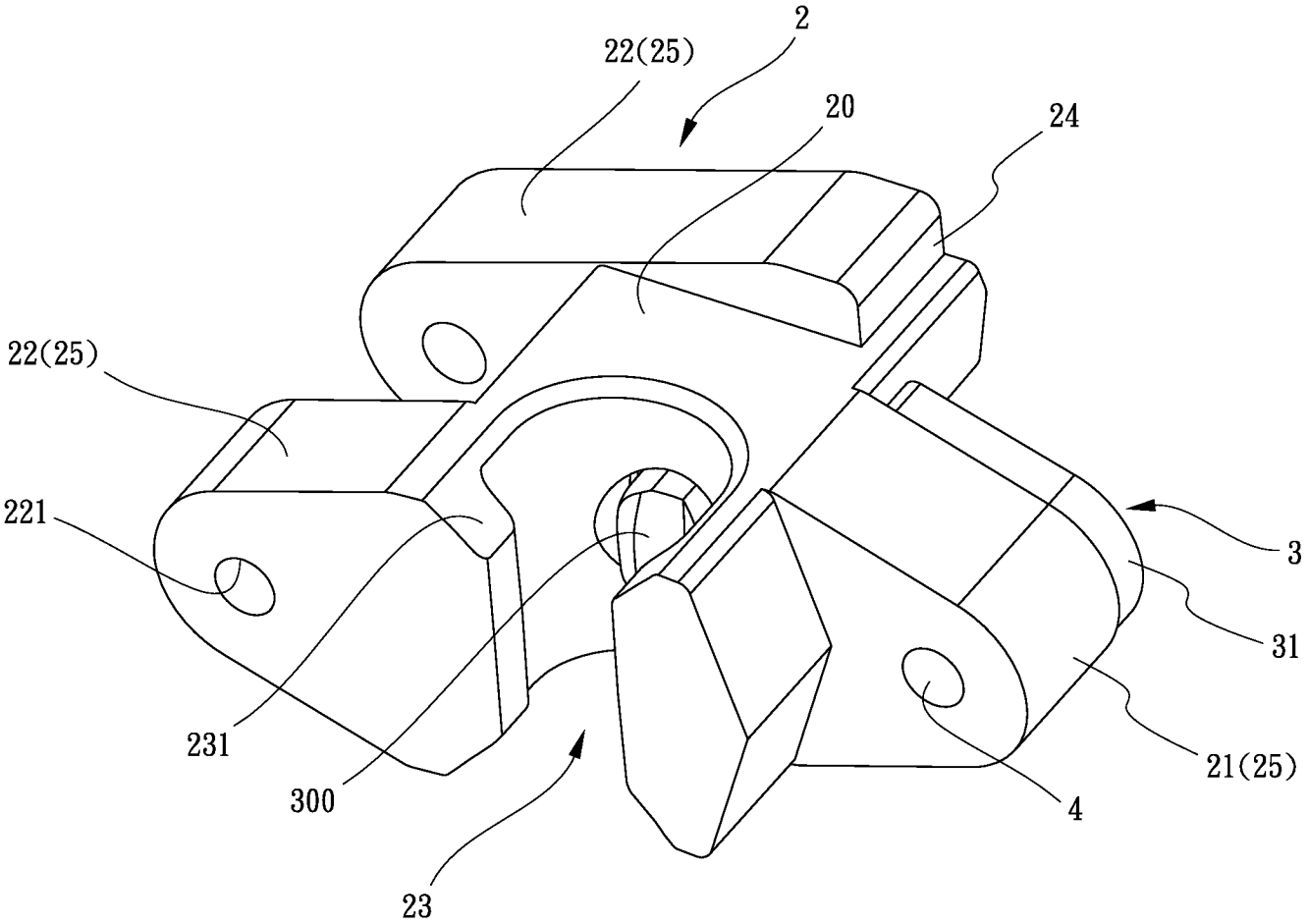
FIG. 3 is a perspective assembled view of the arrow chain structure of the first embodiment, according to the present invention.
Figure 4:
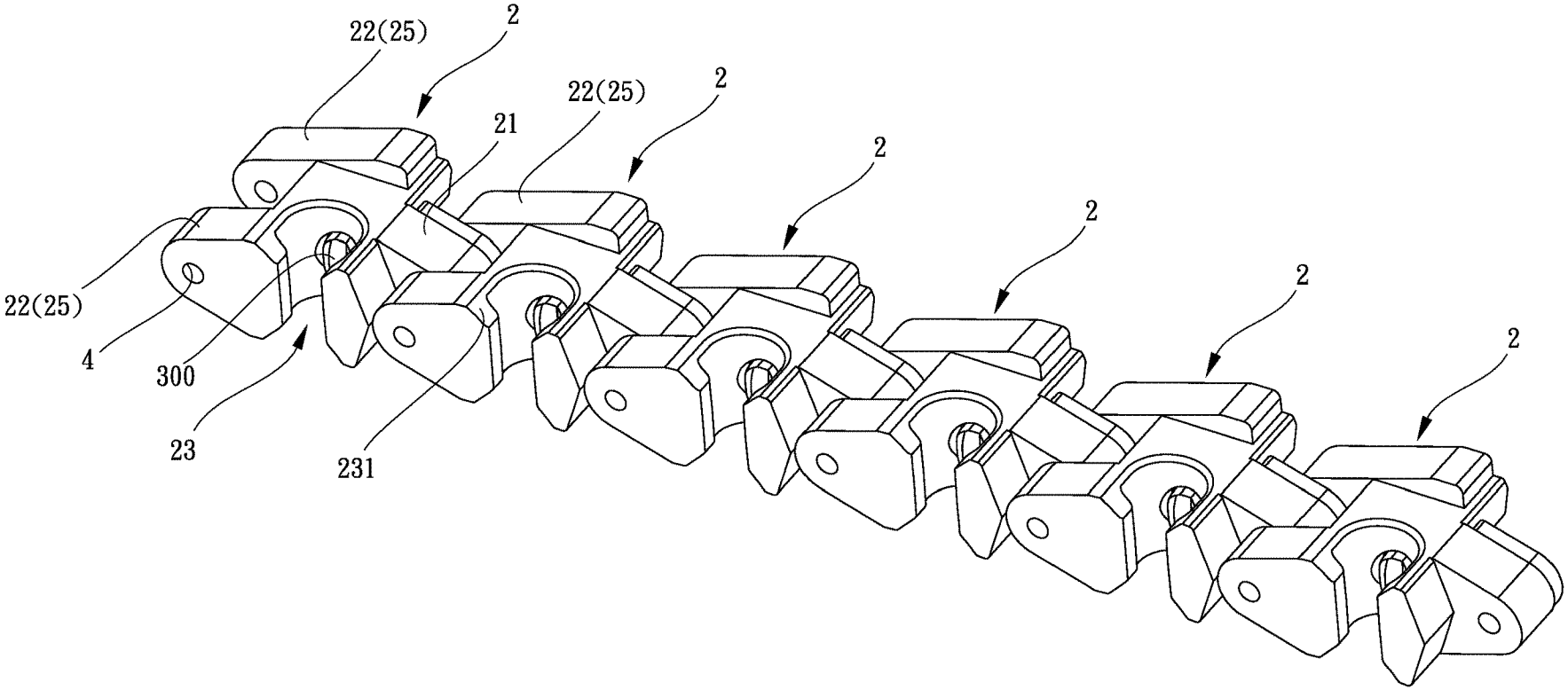
FIG. 4 is a perspective assembled view of the chain-type arrow chain structure of the first embodiment, according to the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

Please refer to FIG. 1 to FIG. 11, which show an arrow chain structure of a first embodiment of the present invention. The arrow chain structure includes arrow chain bodies 2 and extension members 3, each arrow chain body 2 includes a base part 20, and the base part 20 has a pivoting member 25 and an arrow groove 23 formed on a side thereof. The pivoting member 25 includes a first pivoting part 21 and a second pivoting part 22, the second pivoting part 22 of the pivoting member 25 has an accommodation groove 220 formed on a side thereof and corresponding to other side of the arrow groove 23, and the first pivoting part 21 has a first pivoting hole 210, the second pivoting part 22 has a second pivoting hole 221, and the first pivoting hole 210 and the second pivoting hole 221 correspond in position to each other. The arrow groove 23 has a through hole 230 formed on an inner wall of a closed end thereof and two vertical clipping parts 231 formed on an open end thereof. The through hole 230 and the arrow groove 23 are in connection with each other.

Each extension member 3 includes an accommodation end 30 and a pivoting end 31, the accommodation end 30 is accommodated in the accommodation groove 220, the pivoting end 31 is pivotally connected to the first pivoting part 221 of the pivoting member 25, and the accommodation end 30 has a locating part 300 corresponding in position to the through hole 230 of the arrow groove 23, and the pivoting end 31 has a third pivoting hole 310 corresponding in position to the first pivoting hole 210 and the second pivoting hole 221.

The assembly structure of the arrow chain structure of the first embodiment according to the present invention will be illustrated in detail in the following paragraph. The accommodation end 30 of the extension member 3 is accommodated in the accommodation groove 220, and the locating part 300 of the accommodation end 30 is inserted through the accommodation groove 220 and the through hole 230, and exposed out of an inner wall of the arrow groove 23. After the extension member 3 is assembled with the arrow chain body 2, the pivoting member 25 (such as the second pivoting part 22) of each arrow chain body 2 is pivoted with the pivoting member 25 (such as the first pivoting part 21) of another arrow chain body 2, and a hinge connector 4 is inserted through the second pivoting hole 221, the first pivoting hole 210, and the third pivoting hole 310 in sequential order, so as to pivotally connect the arrow chain bodies 2, with each other to form a chain-type arrow chain structure.

Figure 5:
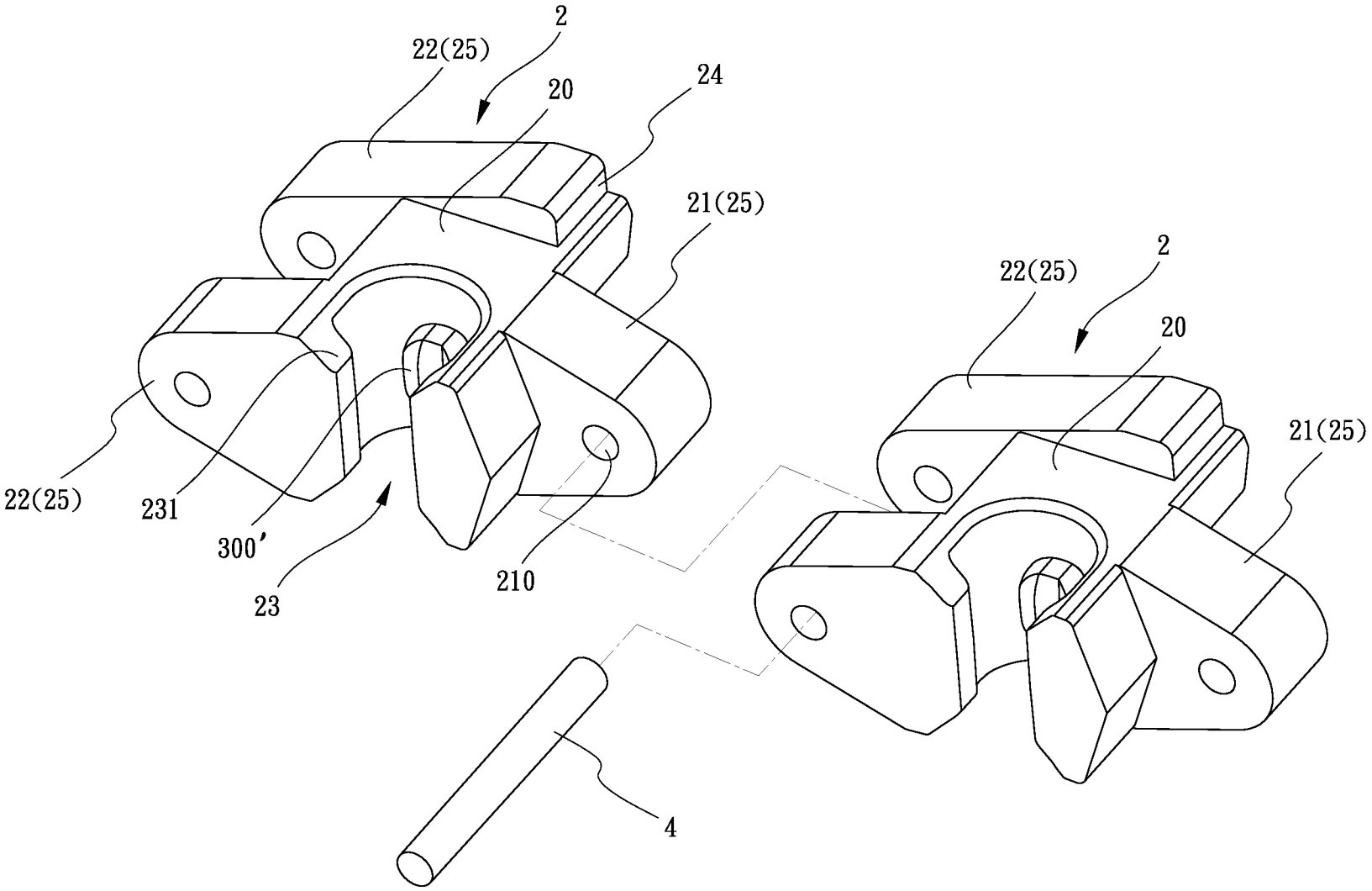
FIG. 5 is a perspective exploded view of an arrow chain structure of a second embodiment, according to the present invention.
Figure 6:
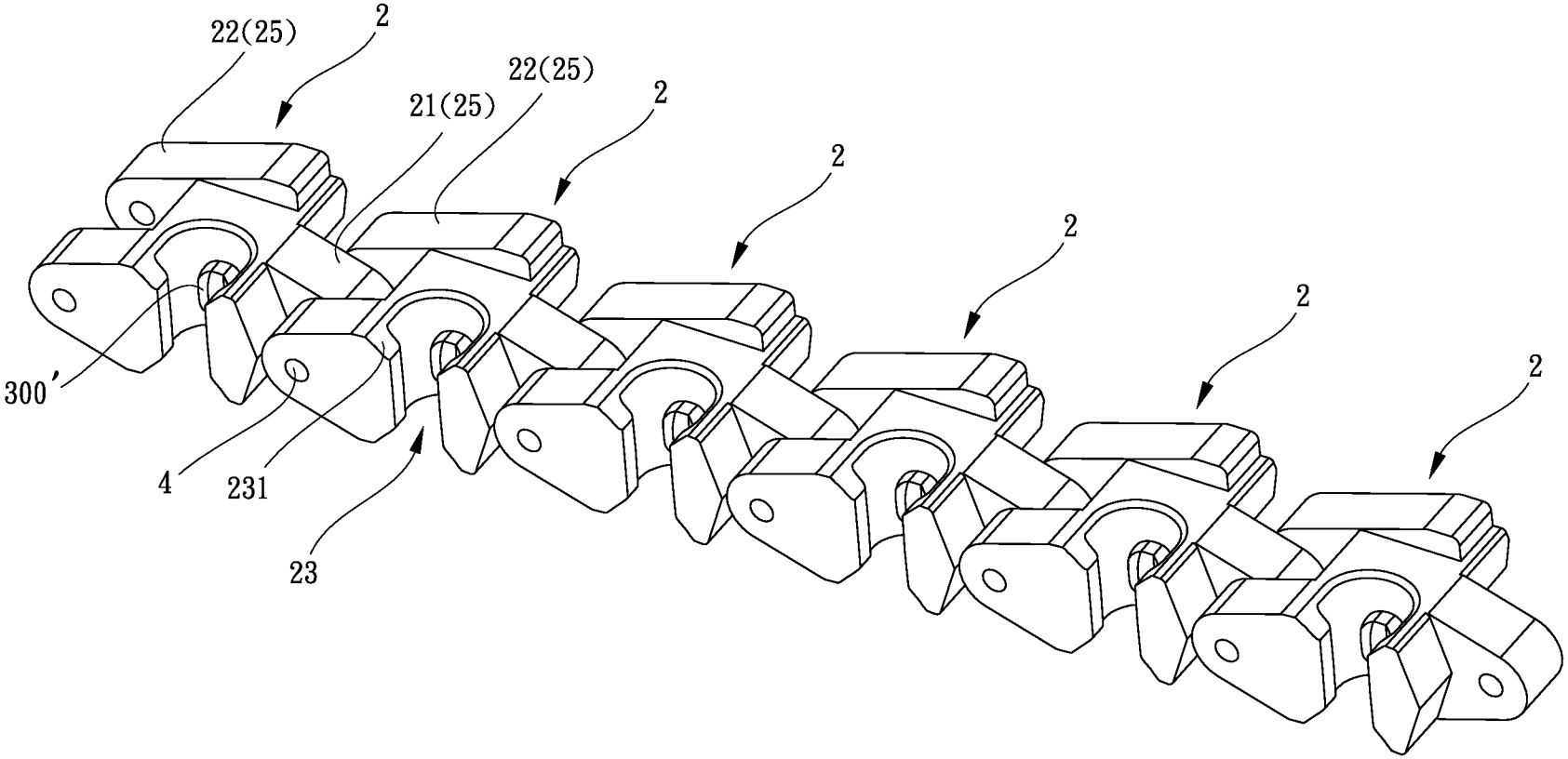
FIG. 6 is a perspective assembled view of a chain-type arrow chain structure of the second embodiment, according to the present invention.
Figure 7:
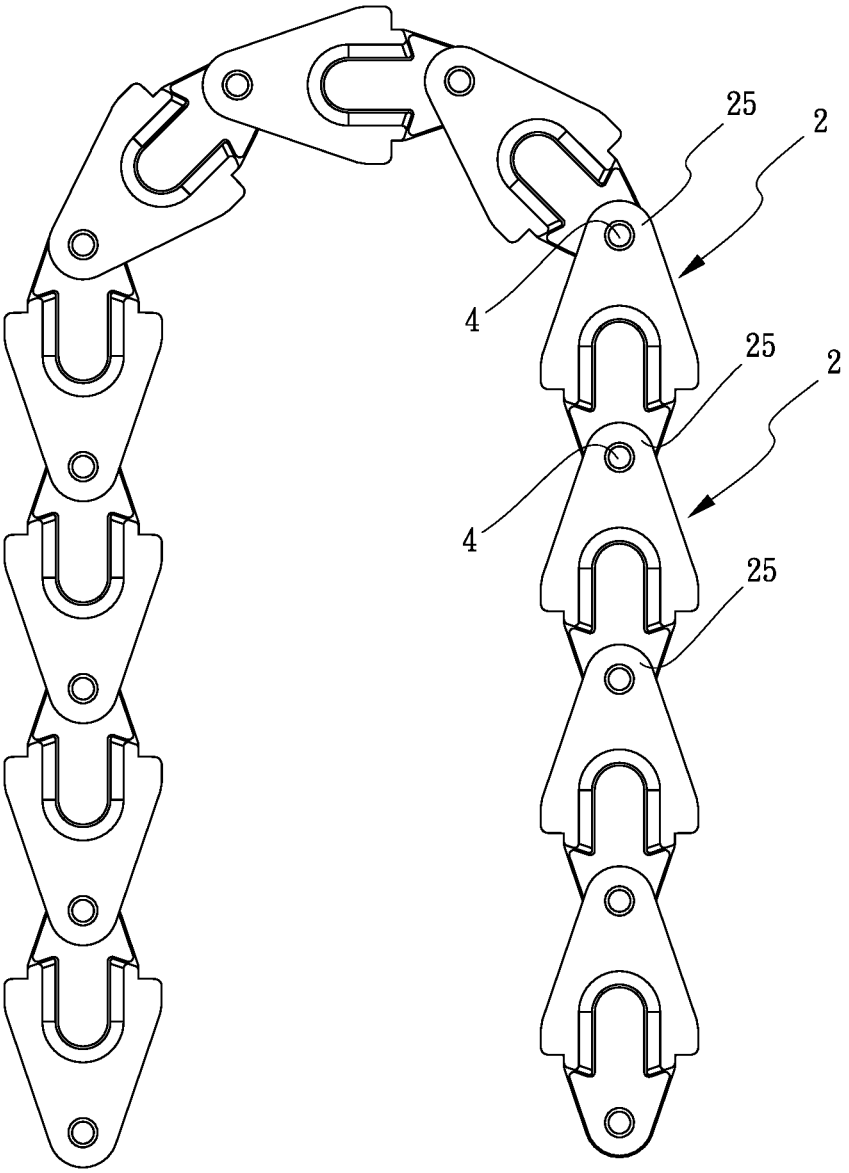
FIG. 7 is a schematic view of a usage status of the chain-type arrow chain structure of FIG. 1, according to the present invention.
Figure 8:
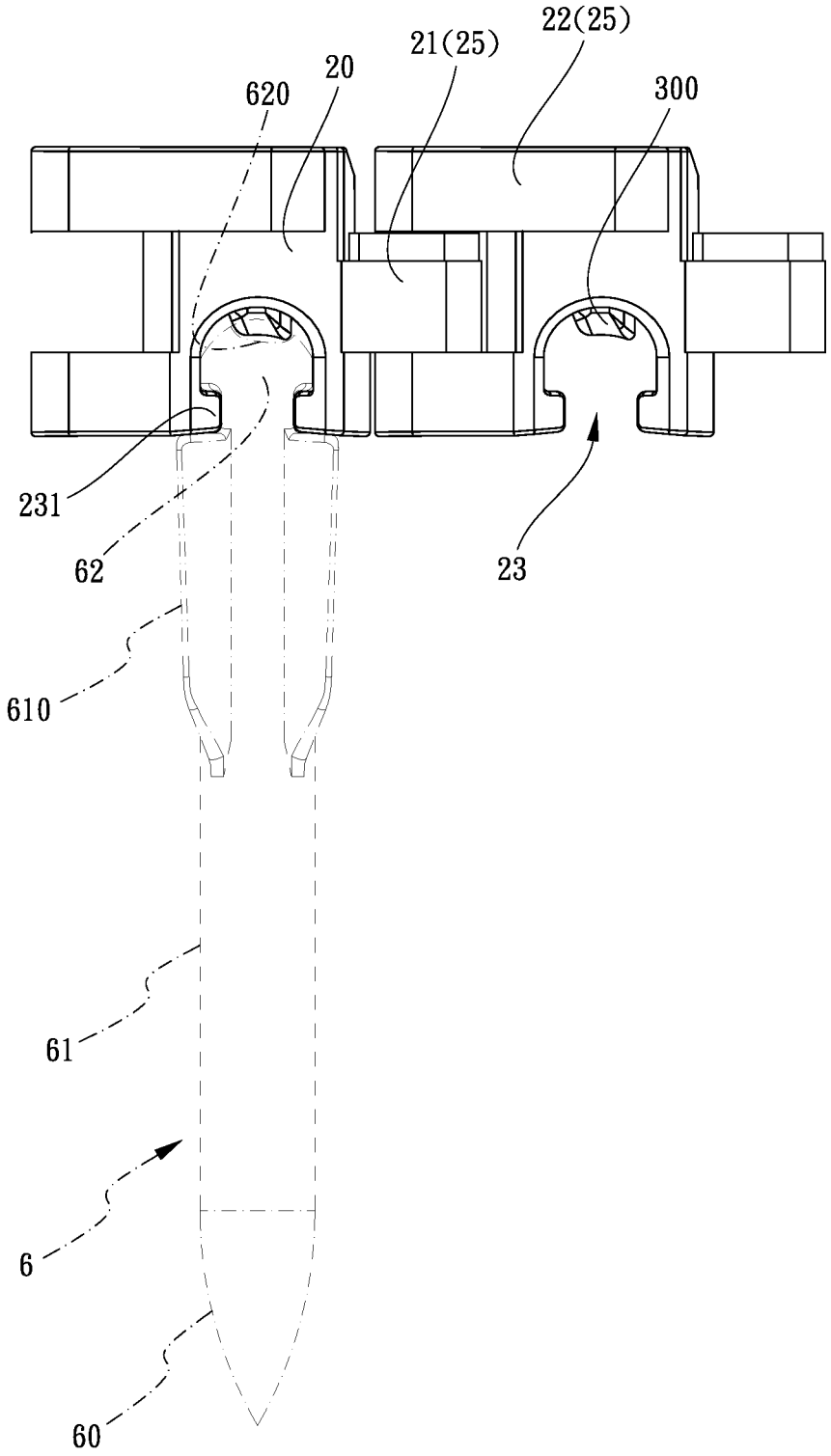
FIG. 8 is a plan view of an arrow chain structure mounted with an arrow body, according to the first embodiment of the present invention.
Figure 9:
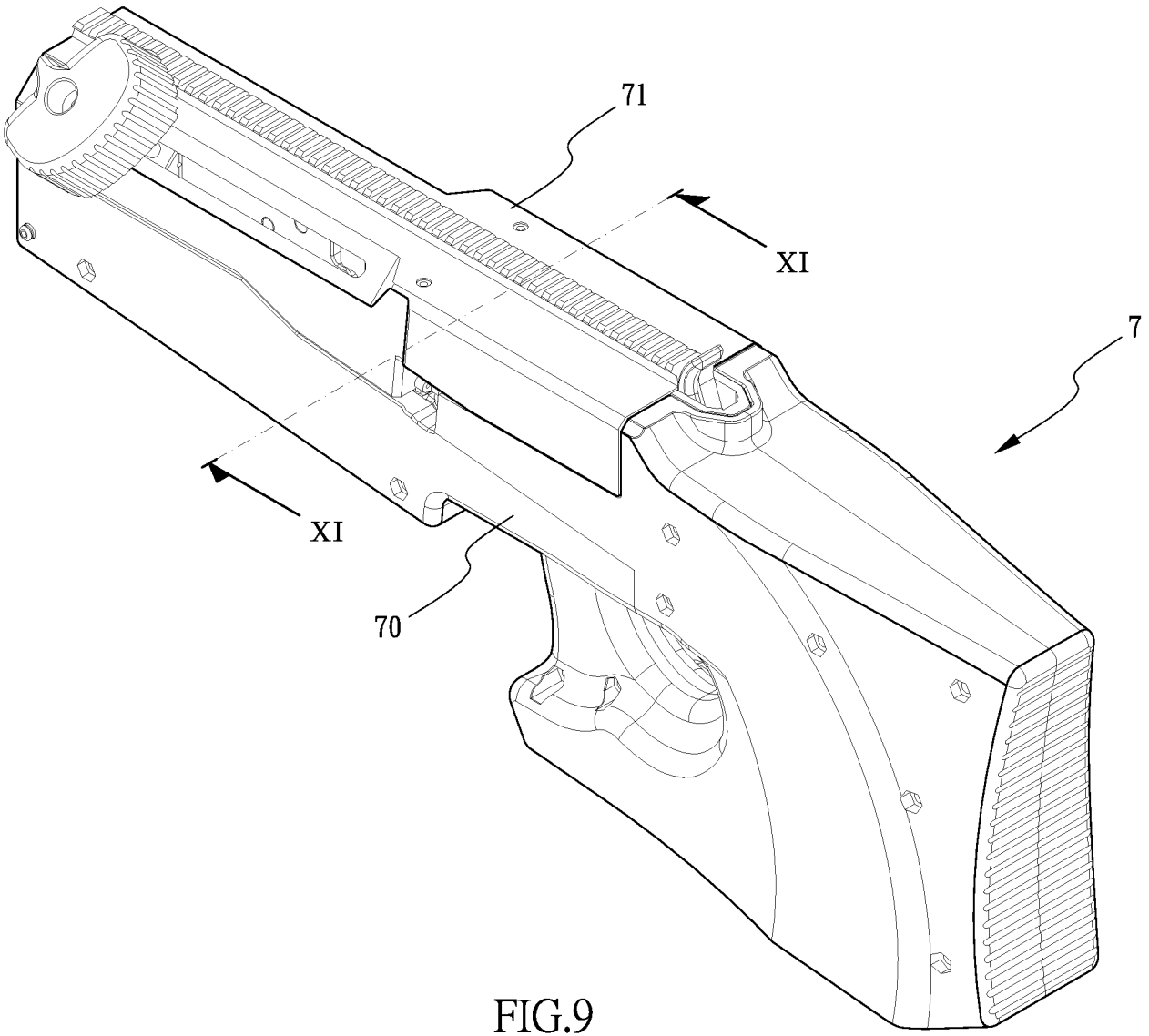
FIG. 9 is a perspective view of a gun body mounted with the arrow chain structure of the first embodiment, according to the present invention.
Figure 10:
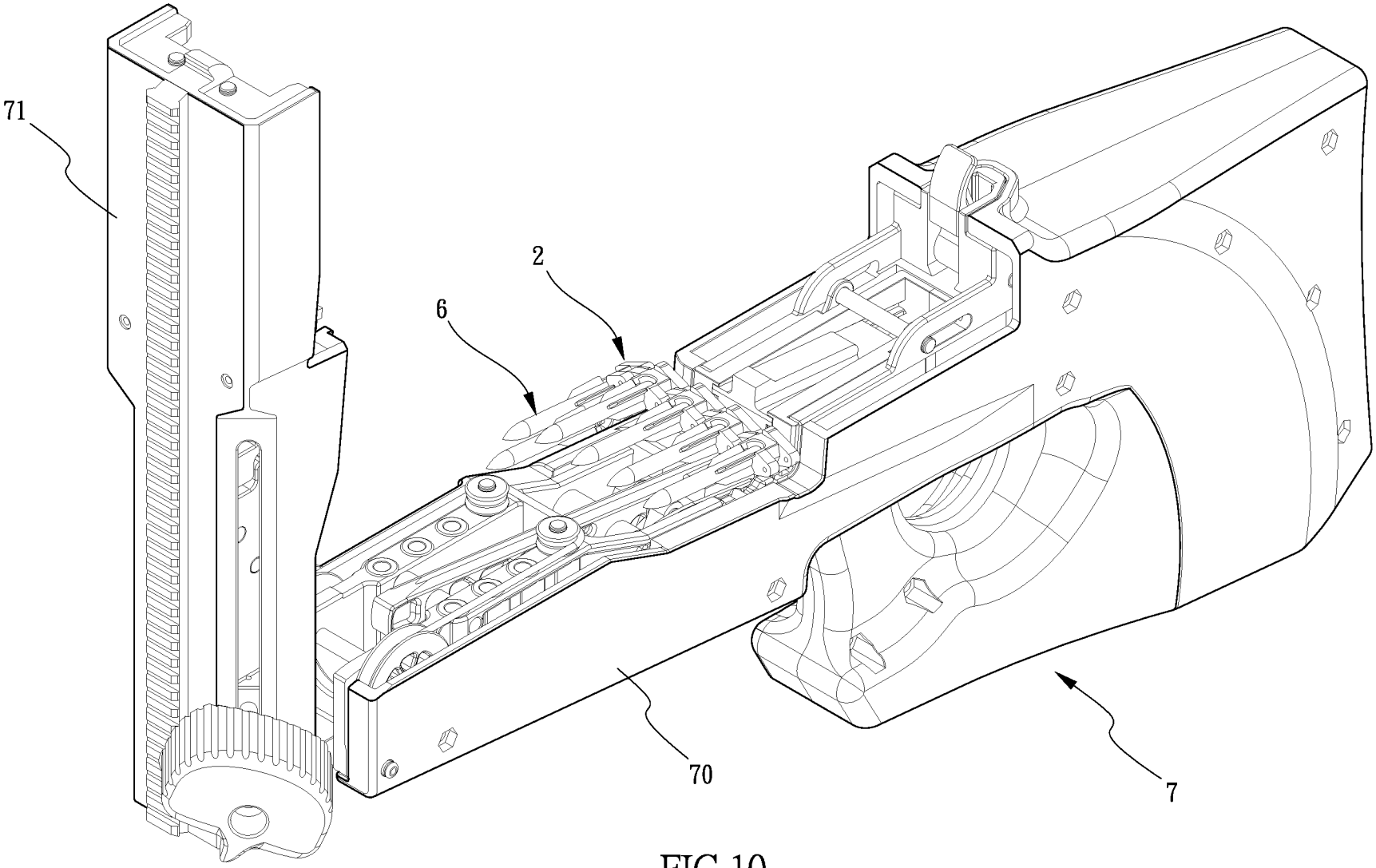
FIG. 10 is a perspective view of the gun body mounted with the arrow chain structure of the first embodiment, according to the present invention.
Figure 11:
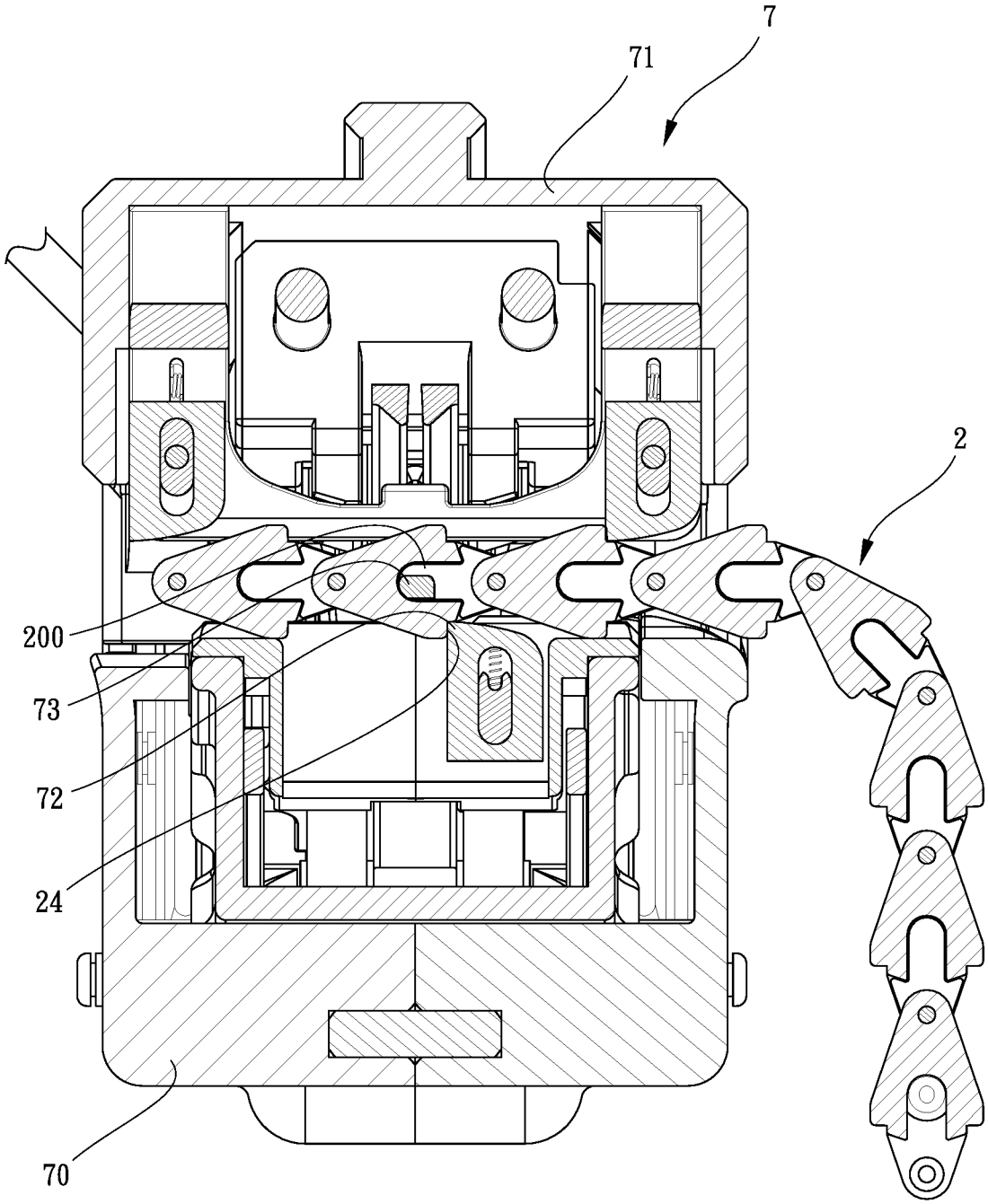
FIG. 11 is a sectional view taken along XI-XI of FIG. 9, according to the present invention.

Please refer to FIG. 5 and FIG. 6, which show an arrow chain structure of a second embodiment, according to the present invention. The arrow chain structure includes arrow chain bodies 2, each arrow chain body 2 includes a base part 20, and the base part 20 has a pivoting member 25 and an arrow groove 23 formed on a side thereof. The pivoting member 25 includes a first pivoting part 21 and a second pivoting part 22, the first pivoting part 21 has a first pivoting hole 210, the second pivoting part 22 has a second pivoting hole 221, and the first pivoting hole 210 and the second pivoting hole 221 correspond in position to each other. The arrow groove 23 has a locating part 300' formed on an inner wall of a closed end thereof, and two vertical clipping parts 231 form on an open end thereof.

The assembly structure of the arrow chain structure of the second embodiment is illustrated in detail in the following paragraphs. The pivoting member 25 (such as the second pivoting part 22) of each arrow chain body 2 is pivoted with the pivoting member 25 (such as the first pivoting part 21) of another arrow chain body 2, a hinge connector 4 is inserted through the second pivoting hole 221 and the first pivoting hole 210 in sequential order, to pivotally connect the plurality of arrow chain bodies 2, with each other to form a chain-type arrow chain structure.

According to illustrations of the first embodiment and the second embodiment, the main technical solution of the present invention is that each arrow chain body 2 includes the pivoting member 25 disposed thereon, the arrow chain bodies 2 are pivotally connected with each other to form the chain-type arrow chain structure via the pivoting members 25. Therefore, a length of the arrow chain structure of the present invention can be adjusted according to different requirements, and the arrow chain structure can be slightly bent or wound, thereby achieving the effect of small volume, easy to accept and carry.

It is worth noting that the extension member 3 of the first embodiment and the second embodiment of the present invention can be made by elastic material to have the slightly-bendable property, so as to improve simplicity in assembly.

Please refer to FIG. 8 to FIG. 11. The arrow chain structure 1 of the present invention can be mounted with arrow bodies 6 and applied in a gun body 7.

The arrow body 6 includes an arrow head 60, an arrow rod 61, feathers 610 disposed on the arrow rod 61, an arrow tail 62, and a locating hole 620 corresponding in position to the locating part 300 (or the locating part 300'). When the arrow body 6 is mounted in the arrow groove 23, the clipping part 231 clips the arrow body 6, and the locating part 300 (or the locating part 300') is located in the locating hole 620. Therefore, the arrow body 6 is stably mounted in the arrow groove 23 and prevented from falling.

The gun body 7 has a gun frame 70, a gun cover 71, and firing members 72 and 73 configured to mount with the arrow chain structure. The firing members 72 and 73 are connected to a transmission part 24 of the arrow chain body 2. When the user operates the gun body 7 to shoot, the firing members 72 and 73 are operated to make the transmission parts 24 drive the arrow chain bodies 2 to move one by one, so as to continuously shoot the arrow bodies 6. It should be noted that the actions of the gun body 7 for shooting is not the technical feature of the present invention, so the detailed description is not repeated herein.

According to above-mentioned contents, the arrow chain structure of the present invention is formed by the arrow chain bodies 2 pivotally connected with each other through the pivoting members 25, so that the arrow chain structure can load multiple arrow bodies 6 to continuously shoot, have a convenient assembling or disassembling operation, and can be bent or wound to achieve the effect of easy to accept and carry.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An arrow chain structure, comprising:

arrow chain bodies, wherein each of the arrow chain bodies comprises a base part, the base part has an arrow groove and a pivoting member disposed on a circumferential side thereof, and the pivoting member has an accommodation groove formed on a side thereof and located opposite to the arrow groove;

extension members, wherein each of the extension members comprises an accommodation end and a pivoting end, the accommodation end is accommodated in the accommodation groove, and the pivoting end is pivotally connected to the pivoting member;

wherein after each of the extension members is assembled with one of the arrow chain bodies, the arrow chain bodies are pivotally connected to each other to form a chain-type arrow chain structure via the pivoting members.

2. The arrow chain structure according to claim 1, wherein the arrow groove has a through hole formed on an inner wall thereof and in connection with the accommodation groove, each of the extension members comprises a locating part disposed on an accommodation end thereof, and the locating part is inserted through the accommodation groove and the through hole to expos out of an inner wall of the arrow groove.

3. The arrow chain structure according to claim 1, wherein the arrow groove has a locating part disposed on an inner wall thereof.

4. The arrow chain structure according to claim 1, wherein the pivoting member comprises a first pivoting part, and a second pivoting part opposite to the first pivoting part.

5. The arrow chain structure according to claim 4, wherein the first pivoting part has a first pivoting hole, the second pivoting part has a second pivoting hole, and the pivoting end has a third pivoting hole, and the first pivoting hole, the second pivoting hole and the third pivoting hole correspond to each other, a hinge connector is inserted through the second pivoting hole, the first pivoting hole, and the third pivoting hole in sequential order, to pivotally connect two of the arrow chain bodies.

6. The arrow chain structure according to claim 1, wherein an arrow body is mounted in the arrow groove, and the arrow groove has a clipping part configured to clip the arrow body.

7. The arrow chain structure according to claim 1, wherein the arrow chain bodies are mounted with the gun body, the gun body has at least one firing member, and each of the arrow chain bodies has a transmission part disposed corresponding to one of the at least one firing member.

8. An arrow chain structure, comprising:

arrow chain bodies, wherein each of the arrow chain bodies comprises a base part, the base part comprises an arrow groove and a pivoting member disposed on a side thereof, and the arrow chain bodies are pivotally connected to each other to form a chain-type arrow chain structure via the pivoting members, and an arrow body mounted in the arrow groove, and the arrow groove having a clipping part configured to clip the arrow body.

9. The arrow chain structure according to claim 8, wherein the arrow groove has a locating part disposed on an inner wall thereof.

10. The arrow chain structure according to claim 8, wherein each of the pivoting members comprises a first pivoting part, and a second pivoting part opposite to the first pivoting part.

11. The arrow chain structure according to claim 10, wherein the first pivoting part has a first pivoting hole, the second pivoting part has a second pivoting hole, and the first pivoting hole and the second pivoting hole correspond in position to each other, a hinge connector is inserted through the second pivoting hole and the first pivoting hole in sequential order, to pivotally connect two of the arrow chain bodies with each other.

12. The arrow chain structure according to claim 8, wherein the arrow chain bodies are mounted with the gun body, the gun body has at least one firing member, and each of the arrow chain bodies has a transmission part disposed corresponding to one of the at least one firing member.

* * * * *